US005597346A

United States Patent [19]

Hempel, Jr.

[11] Patent Number: 5,597,346

[45] Date of Patent: Jan. 28, 1997

[54] METHOD AND APPARATUS FOR HOLDING A SEMICONDUCTOR WAFER DURING A CHEMICAL MECHANICAL POLISH (CMP) PROCESS

[75] Inventor: Eugene O. Hempel, Jr., Garland, Tex.

[73] Assignee: Texas Instruments Incorporated, Dallas, Tex.

[21] Appl. No.: 401,738

[22] Filed: Mar. 9, 1995

[51] Int. Cl.[6] ..... B24B 7/00

[52] U.S. Cl. ..... 451/287; 451/41; 451/36; 451/289

[58] Field of Search ..... 451/41, 60, 36, 451/285, 287, 288, 289, 397, 398, 286, 402, 446

[56] References Cited

U.S. PATENT DOCUMENTS

| | | | |
|---|---|---|---|
| 2,826,009 | 3/1958 | Sharson | 451/286 |
| 2,883,802 | 4/1959 | Katzke | 451/278 |
| 3,568,371 | 3/1971 | Day et al. | 451/286 |
| 3,659,384 | 5/1972 | Day | 452/286 |
| 5,078,801 | 1/1992 | Mauk | 451/285 |
| 5,232,875 | 8/1993 | Tuttle et al. | 437/225 |

FOREIGN PATENT DOCUMENTS

| | | | |
|---|---|---|---|
| 812231 | 4/1959 | United Kingdom | 451/286 |

*Primary Examiner*—Bruce M. Kisliuk
*Assistant Examiner*—Eileen Morgan
*Attorney, Agent, or Firm*—W. James Brady, III; Richard L. Donaldson

[57] ABSTRACT

An improved semiconductor wafer carrier (16) holds semiconductor wafer (14) during a CMP process and achieves a more uniform layer of slurry (24) at greater polishing speeds. Carrier (16) directs slurry (24) between semiconductor wafer (14) and conditioning pad (22) and includes wafer holding surface (52) for holding semiconductor wafer (14) as semiconductor wafer (14) contacts conditioning pad (22) and slurry (24). Outer rim portion (56) surrounds semiconductor wafer holding surface (52). A plurality of slurry channels (58) associate with outer rim portion (56) for receiving slurry (24) and directing slurry (24) between semiconductor wafer (14) and conditioning pad (22) for maintaining a uniform layer of slurry (24) between semiconductor wafer (14) and conditioning pad (22).

18 Claims, 3 Drawing Sheets

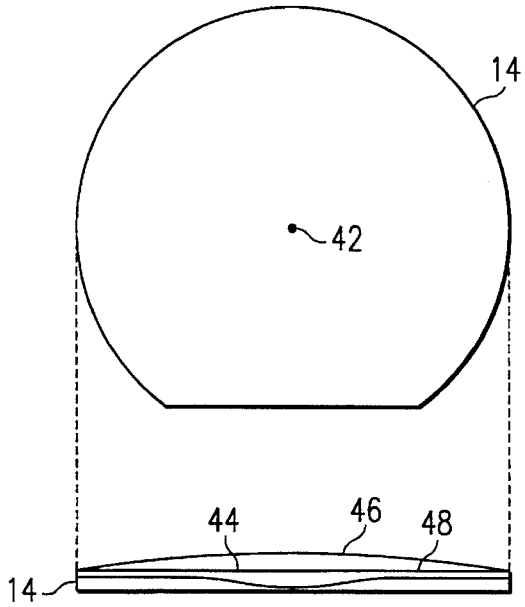
FIG. 2A
FIG. 2B
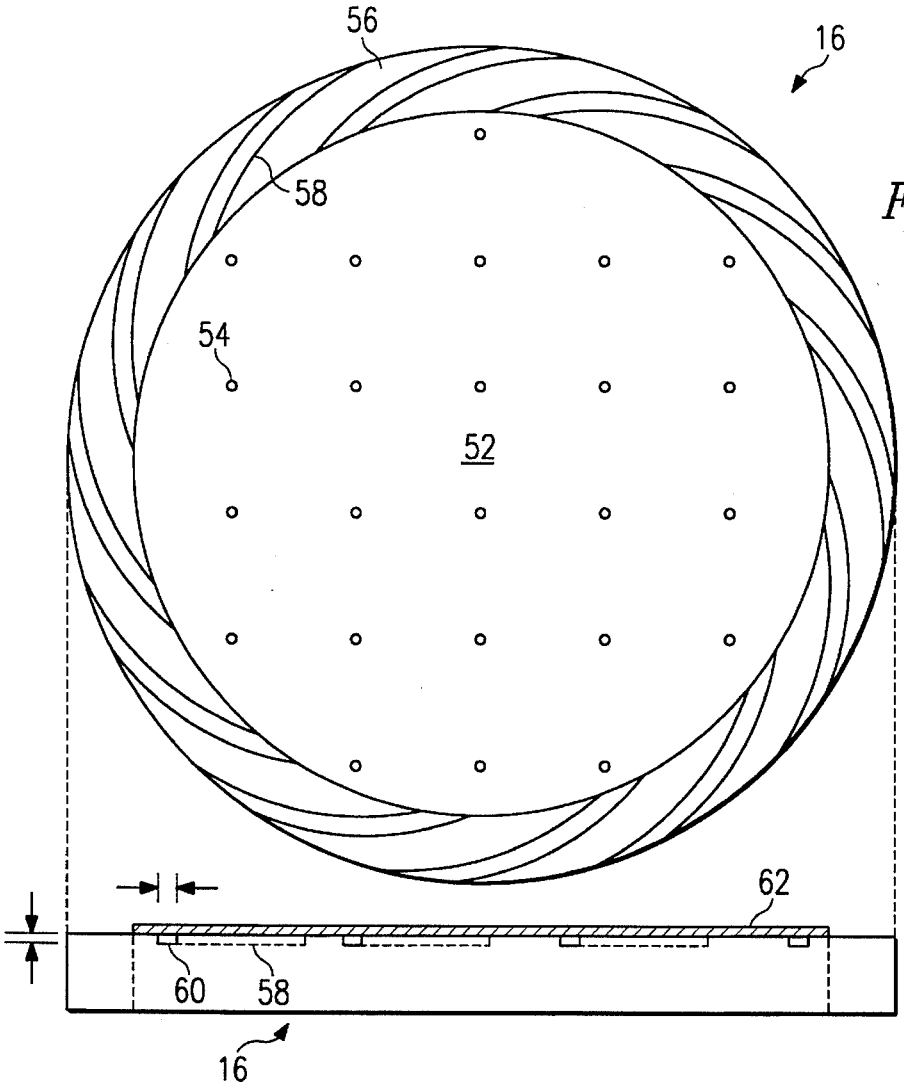
FIG. 3
FIG. 4

METHOD AND APPARATUS FOR HOLDING A SEMICONDUCTOR WAFER DURING A CHEMICAL MECHANICAL POLISH (CMP) PROCESS

TECHNICAL FIELD OF THE INVENTION

The present invention relates to fabricating electronic devices and, more particularly, to a method and apparatus for holding a semiconductor wafer during a CMP process that promotes more uniform CMP processing of the semiconductor wafer at greater speeds for improved polishing quality and increased electronic device processing throughput.

BACKGROUND OF THE INVENTION

Advances in electronic devices generally include reducing the size of the components that form integrated circuits. With smaller circuit components, the value of each unit area of a semiconductor wafer becomes higher. This is because the ability to use all of the wafer area for integrated circuit components improves. To properly form an integrated circuit that employs a much higher percentage of usable wafer area, it is critical that contaminant particle counts on the semiconductor wafer surface be reduced below levels which were previously acceptable. For example, minute particles of oxides and metals of less than 0.2 microns are unacceptable for many of the popular advanced circuit designs, because they can short out two or more conducting lines. In order to clean a semiconductor wafer and remove unwanted particles, a process known as chemical mechanical polishing or chemical mechanical polish (hereinafter "CMP") has become popular.

CMP systems place a semiconductor wafer in contact with a conditioning pad that rotates relative to the semiconductor wafer. The semiconductor wafer may be stationary or it may also rotate on a carrier that holds the wafer. Between the semiconductor wafer and the conditioning pad, CMP systems often use a slurry. The slurry is a liquid having the ability to lubricate the moving interface between the semiconductor wafer and the conditioning pad while mildly abrading and polishing the semiconductor wafer surface. In this operation, it is important that there be a uniform layer of slurry at the interface between the semiconductor wafer and the conditioning pad. Too much slurry at the interface can cause too little conditioning or polishing by the conditioning pad. Too little slurry may cause too much conditioning. This is because the heat from friction that the semiconductor wafer experiences increases from a lack of lubrication, as well as the fact that more of the abrasive conditioning pad surface directly contacts the semiconductor wafer.

In conventional CMP systems, to ensure that a sufficient layer of slurry exists at the wafer-pad interface, the relative rotational speeds of the conditioning pad and semiconductor wafer are carefully controlled and somewhat limited. A greater speed for the conditioning pad relative to the semiconductor wafer, not only increases the removal rate of oxides, metals, and other contaminants on the semiconductor wafer, but also adversely affects the polishing uniformity. If it were possible to maintain more uniformity in the slurry layer at greater speeds, CMP process throughput could increase. This increased throughput could have numerous beneficial effects.

SUMMARY OF THE INVENTION

Therefore, a need has arisen for a method and apparatus for CMP processing of a semiconductor wafer that provides improved semiconductor wafer polish uniformity.

There is a need for an improved method and apparatus for CMP processing of a semiconductor wafer that maintains a uniform layer of slurry at the semiconductor wafer-conditioning pad interface.

There is a further need for an improved CMP method and apparatus that permits a greater relative rotational speed between the semiconductor wafer and the conditioning pad for increasing the removal rate of contaminants from the semiconductor wafer, while maintaining a desired level of slurry layer uniformity during the process.

There is a further need for an improved method and apparatus for CMP processing of a semiconductor wafer that provides a more uniform slurry layer at the wafer-pad interface and that may be used on a wide variety of CMP polishing machines.

Accordingly, the present invention provides a method and apparatus for CMP polishing of a semiconductor wafer that maintains a more uniform layer of slurry at the wafer-pad interface for promoting more uniform semiconductor wafer polishing and increasing semiconductor wafer polishing throughput and that substantially eliminates or reduces disadvantages and problems associated with known CMP methods and systems.

More specifically, one aspect of the present invention provides an improved wafer polishing carrier for holding a semiconductor wafer during a CMP process, the process involving the use of a slurry that lubricates the interface between the semiconductor wafer and the conditioning pad and that polishes the semiconductor wafer surface. The carrier directs the slurry between the semiconductor wafer and the conditioning pad and includes a wafer holding surface for holding the semiconductor wafer as the semiconductor wafer contacts the conditioning pad and slurry. An outer rim portion of the carrier surrounds the carrier device surface. A plurality of slurry channels associated with the outer rim portion receive slurry and direct the slurry between the semiconductor wafer and the conditioning pad to maintain an essentially uniform layer of slurry between the semiconductor wafer and the conditioning pad.

Another aspect of the invention provides an improved CMP system and related method for using the system to polish the semiconductor wafer. The system includes a conditioning pad that has a conditioning surface for receiving the semiconductor wafer and polishing the semiconductor wafer surface. A slurry applies to the conditioning pad and lubricates the interface between the semiconductor wafer and the conditioning pad. A carrier holds the semiconductor wafer in contact with the conditioning pad and maintains an essentially uniform layer of slurry between the semiconductor wafer and the conditioning pad. The carrier device includes a wafer holding surface that holds the semiconductor wafer as the wafer contacts the conditioning pad. The carrier includes an outer rim portion that surrounds the carrier device surface and a plurality of slurry channels within the outer rim portion that receive slurry and direct the slurry between the semiconductor wafer and the conditioning pad. This promotes an essentially uniform layer of slurry between the semiconductor wafer and the conditioning pad.

A technical advantage of the present invention is that it promotes an essentially uniform layer of slurry between the semiconductor wafer and the conditioning pad. This is achieved by increasing the slurry flow into the wafer-pad interface. The slurry channels of the present invention receive slurry that is on the conditioning pad and direct it into the interface causing an increased flow of slurry to the interface. This increased slurry flow reduces heat generation at the wafer-pad interface to reduce the coefficient of friction across the semiconductor wafer during CMP processing.

Another technical advantage of the present invention is that it eliminates a damming or accumulation of slurry that occurs with conventional wafer carriers on the conditioning pad before the slurry enters the wafer-pad interface. By receiving the slurry in the slurry channels, the present invention eliminates deposits or accumulations of slurry at the outside of the wafer-pad interface and directs the slurry that would otherwise be accumulated at this outer rim portion into the interface.

Yet another technical advantage of the present invention is that it makes possible increasing the rate of oxide or metal removal from the semiconductor wafer surface. By maintaining a more uniform layer of slurry at the wafer-pad interface, the present invention permits a greater relative speed and commensurate greater removal rate. As the removal rate increases, the amount of time for polishing each semiconductor wafer decreases. This decrease in the semiconductor wafer CMP processing time may result in an overall increase in the throughput of semiconductor wafers in CMP process machines.

BRIEF DESCRIPTION OF THE DRAWINGS

For a more complete understanding of the invention and the advantages thereof, reference is now made to the following description which is to be taken in conjunction with the accompanying drawings in which like reference numerals indicate like features and wherein:

FIGS. 2*a* and 2*b* illustrate the phenomenon of nonuniform polishing that a nonuniform slurry layer may cause;

FIG. 3 illustrates a frontal view of a semiconductor wafer carrier that includes the slurry channels of the present embodiment;

FIG. 4 illustrates a side view of the carrier embodiment of FIG. 3;

DETAILED DESCRIPTION OF ILLUSTRATIVE EMBODIMENTS

Illustrative embodiments of the present invention are illustrated in the FIGUREs wherein like numerals are used to refer to like and corresponding parts of the various drawings.

Figure 1:
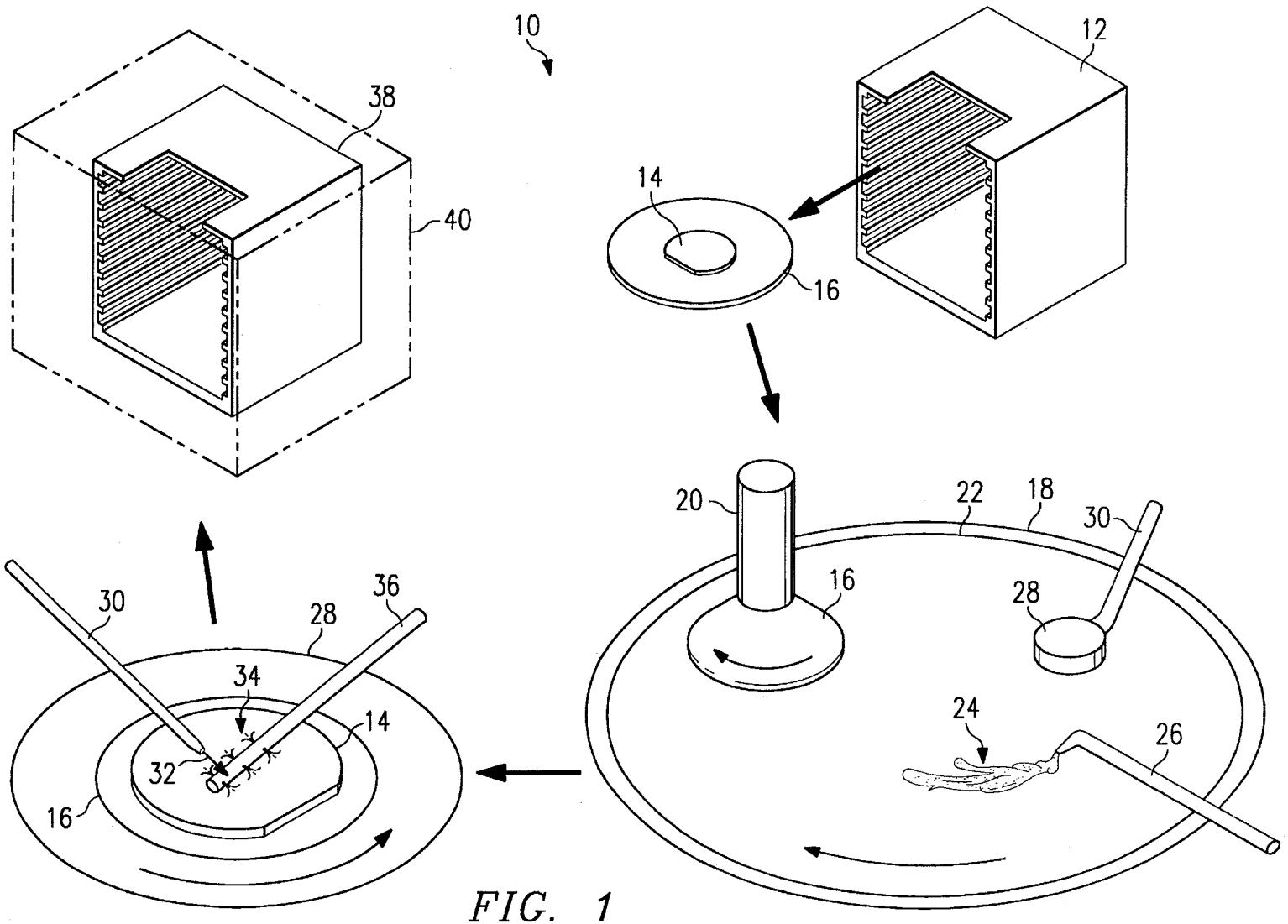
FIG. 1 provides a flow diagram of the chemical mechanical polishing method and system which incorporates the present embodiment of the invention.

FIG. 1 shows a CMP system process flow 10 that incorporates the present embodiment. In FIG. 1, load cassette 12 contains numerous semiconductor wafers, such as semiconductor wafer 14. CMP system process flow 10 transfers semiconductor wafer 14 to carrier 16 which by vacuum force holds semiconductor wafer 14. Carrier 16 attaches to robotic arm 20 which turns carrier 16 upside down and transfers semiconductor wafer 14 and carrier 16 to primary platen 18. Primary platen 18 includes conditioning pad 22 that polishes semiconductor wafer 14 and rotates, in this example, clockwise. During conditioning, carrier 16 rotates so that semiconductor wafer 14 contacts conditioning pad 22 while rotating in a direction either the same as or opposite to that in which conditioning pad 22 rotates. This rotation promotes the combination of polishing by conditioning pad 22 and lubricating and polishing by slurry 24. Slurry dispensing mechanism 26 dispenses slurry 24 to coat conditioning pad 22. End effector 28 conditions conditioning pad 22 to receive slurry 24 by moving back and forth over conditioning pad 22 under the control of robotically-controlled positioning arm 30.

In completing CMP process flow 10, after polishing semiconductor wafer 14, robotic arm 20 moves carrier 16 to secondary platen 28. At secondary platen 28, a cleansing spray mechanism including wafer spray jet 30 sprays water 32 past pH control spray 34 that comes from spray arm 36. This step removes slurry 24 from semiconductor wafer 14 and prepares semiconductor wafer 14 for transfer to unload cassette 38 within bath 40. This part of CMP process flow 10 is described more particularly in U.S. patent application Ser. No. 08/298,808 entitled "Method and System for Chemical Mechanical Polishing of a Semiconductor Wafer" by G. Hempel, filed on Aug. 31, 1994, and assigned to Texas Instruments Incorporated of Dallas, Tex. (hereinafter "Hempel-1"), which is here expressly incorporated by reference.

The present invention may also be used in conjunction with a conditioning pad 22 formed according to the concepts of U.S. patent application Ser. No. 08/333,674 entitled "Method and Apparatus for Performing Chemical Mechanical Polish (CMP) of a Wafer" by G. Hempel filed on Nov. 3, 1994, and assigned to Texas Instruments Incorporated of Dallas, Tex. (hereinafter "Hempel-2") which is herein expressly incorporated by reference. Hempel-2 describes a conditioning pad for polishing a semiconductor wafer formed from a flat polymer sheet for adhering to primary platen 18. The flat polymer sheet receives slurry 24 that lubricates the conditioning pad and semiconductor wafer 14 as they contact one another. The conditioning pad includes slurry recesses that hold slurry 24 and a plurality of slurry channel paths that form flow connections between predetermined ones of slurry recesses. The conditioning pad of Hempel-2 maintains a desired level of slurry 24 between semiconductor wafer 14 and the conditioning pad to increase the oxide layer removal rate from semiconductor wafer 14, make the semiconductor wafer 14 surface more uniform, and minimize edge exclusion that may occur in the semiconductor wafer 14 CMP process.

A problem that exists in conventional CMP systems is that slurry 24 on conditioning pad 22 accumulates along the rim of carrier 16 during the CMP process. This prevents a sufficiently uniform layer of slurry 24 from lubricating the interface between semiconductor wafer 14 and conditioning pad 22.

FIGS. 2*a* and 2*b* illustrate the results of the phenomenon that the present embodiment addresses. In particular, semiconductor wafer 14 of FIGS. 2*a* and 2*b* is shown in a frontal view in FIG. 2*a* and in a side view in FIG. 2*b*. If an insufficiently uniform layer of slurry 24 arises at the interface between semiconductor wafer 14 and conditioning pad 22 during CMP processing, such as at center 42, the nonuniform polishing that FIG. 2*b* more clearly depicts may occur. For example, instead of the desirable flat surface 44 of FIG. 2*b*, an excessive amount of slurry at semiconductor wafer 14 can reduce the polishing at center 42. This may produce convex curved surface 46 wherein an insufficient amount of oxide or metal has been removed from semiconductor wafer 14. On the other hand, with an layer of slurry 24 that is too thin or nonexistent at the wafer-pad interface, semiconductor wafer concave curved surface 48 may result. This excessive polishing may damage the circuitry of semiconductor wafer 14 if circuits have been placed on wafer 14. In addition, this may prevent the use of semiconductor wafer 14 for receiving integrated circuits in subsequent fabrication processes.

FIG. 3 illustrates a frontal view of carrier 16 according to the present embodiment of the invention that addresses this problem. In particular, carrier 16 includes wafer holding surface 52 that may receive semiconductor wafer 14. Wafer holding surface 52 may include a plurality of vacuum holes 54 for holding, by way of vacuum force, semiconductor wafer 14. In the present embodiment, carrier 16 includes outer rim portion 56 that surrounds wafer holding surface 52. Outer rim portion 56 includes a plurality of wafer channels 58. Wafer channels 58 rotate and direct slurry 24 into the interface between semiconductor wafer 14 and conditioning pad 22.

The curved shape of slurry channels 58 causes them to act as a jet that pulls in slurry 24 and forces it between semiconductor wafer 14 and conditioning pad 22. The distribution of slurry channels 58 within outer rim portion 56 is selected so as to maintain a uniform introduction of slurry at the wafer-pad interface.

FIG. 4 shows a side view of carrier 16 to illustrate the approximate depth of slurry channels 58 and other features associated with carrier 16 of the present embodiment. Slurry channels 58 include slurry channel inlet 60 that receives slurry 24 from the conditioning pad 22 surface and directs slurry 24 into the wafer-pad interface. In the present embodiment, for example, slurry channel inlet 60 has an approximate width of 0.1 inches with a depth of 0.01 inches. Depending on the viscosity of slurry 24 and other design parameters for a given CMP system, different widths and depths of slurry channel inlet 60 may be desired. As FIG. 4 also shows, wafer pad 62 may also be used to raise the semiconductor wafer 14 only slightly above outer rim portion 56.

FIG. 4 further illustrates that above wafer holding surface 52 appears pad 62. Semiconductor wafer 14 sits on pad 62 and is elevated. This produces a wafer differential that permits applying all of the downward force from robotic arm 20 through carrier 16 to the wafer pad interface. It is important, however, that the height difference between semiconductor wafer 14 and outer rim portion 56 be low. This prevents slurry 24 from being trapped between semiconductor wafer 14 and pad 62. This also prevents the slurry 24 from entering vacuum holes 54 of wafer holding surface 52.

Figure 5:
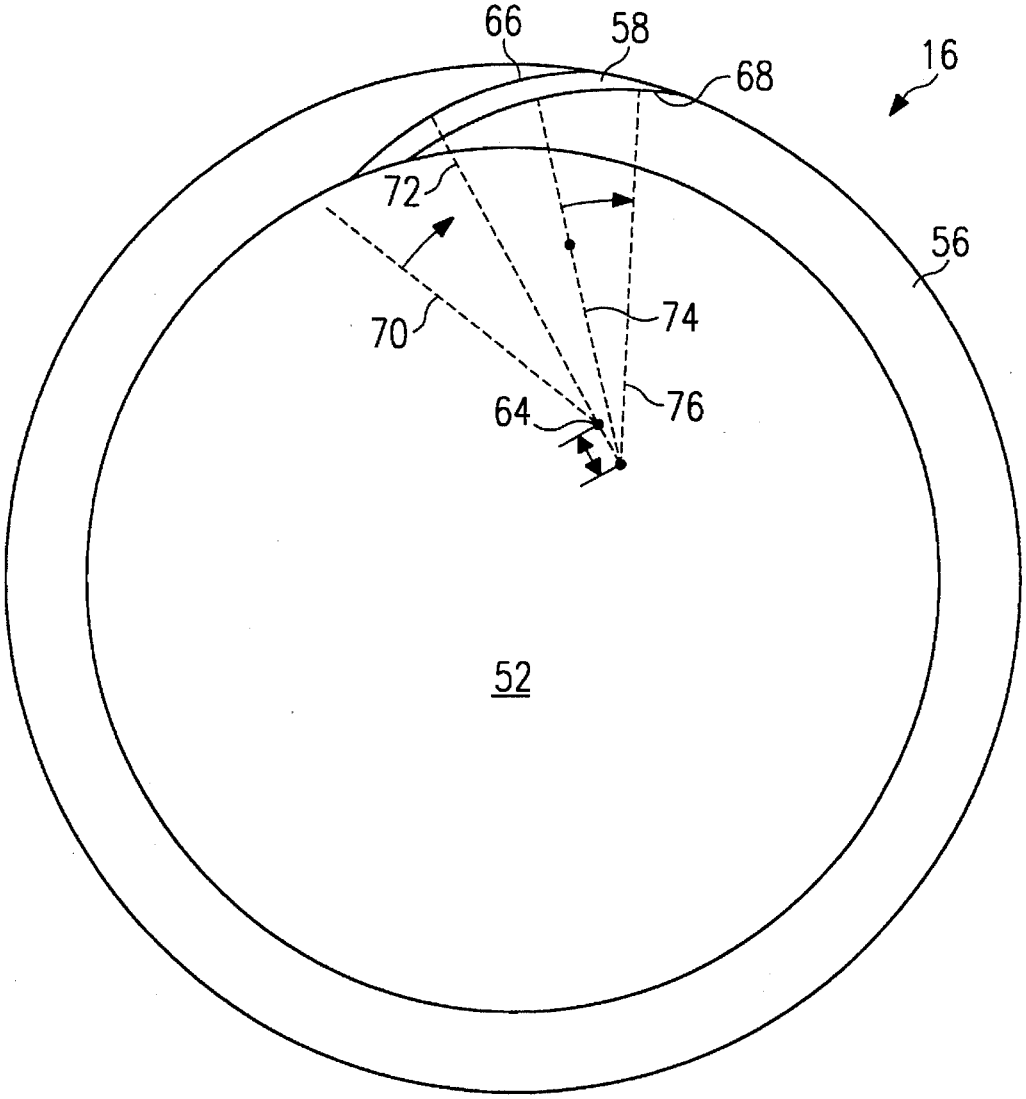
FIG. 5 conceptually illustrates forming the slurry channels of the present embodiment in a semiconductor wafer carrier.

FIG. 5 shows the formation of carrier device 16. Generally, the formation of wafer holding surface 52, wafer pad 62, and outer rim portion 56 may proceed in a manner similar to that of known carrier devices for CMP systems. In forming slurry channels 58 of carrier 16, a machine tool may be devised to have a preselected cutting radius that may be moved to form curved slurry channels 58. Therefore, at cutting arc center 64 a cutting tool may be positioned to cut arc 66 and then moved to continue grooving or cutting to line 68. This forms slurry channel 58 that has contact with wafer holding surface 52 and receives slurry 24 at slurry inlet 60.

A particularly attractive feature in the present invention is that it may be applied to a conventional carrier for a CMP system. By carefully constructing slurry channels 58 in outer rim portion 56 of carrier 16, is possible to economically adapt an existing CMP system for improved operational speed and resulting wafer throughput, as well as to provide improved results for each polished semiconductor wafer 14. The aperture of channels 58 depends on the radius from center of curvature 64 to curved line 66, for example. This may vary according to the desired angle that slurry channel 58 is to assume. Thus for example, if it is desired that channel 58 have a greater length than appears in FIG. 5, radius 70 may be longer. On the other hand, if a greater angle is desired than appears in FIG. 5, radius 70 may be shorter and center of curvature 64 closer to outer rim portion 56.

A device for forming slurry channel 58 may be a computer numerical controlled (CNC) machine that forms a precisely machined curved groove in outer rim portion 56. In FIG. 3, twelve slurry channels 58 appear. These twelve slurry channels 58 relate to carrier 16 which is preferably suited for a six-inch semiconductor wafer 14. For an eight-inch semiconductor wafer 14, either the width of channels 44 or the number of channels may changed for a preferred embodiment.

Figure 6:
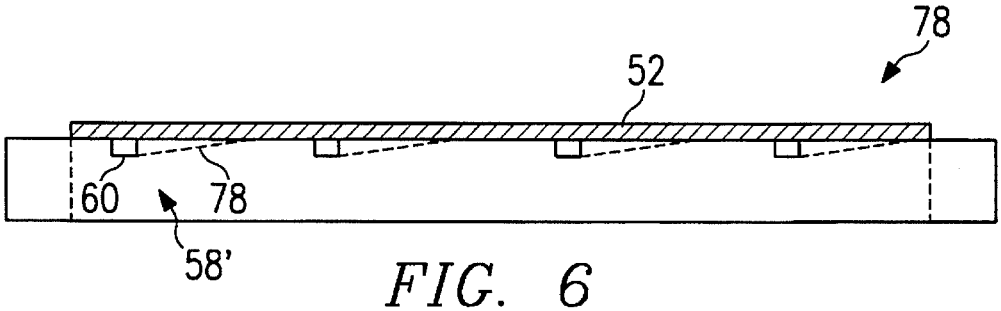
FIG. 6 illustrates an alternative embodiment of the slurry channels of the present invention.

FIG. 6 illustrates an alternative embodiment of the present invention. To decrease flow barriers to wafer holding surface 52, an alternative embodiment wafer carrier 56 includes slurry channels 58' having a slurry channel inlet 60' that is essentially similar to slurry channel inlet 60 of the preferred embodiment. Slurry channel 58' may have a slurry ramp 78 with a tapered depth while otherwise formed to have the same or similar frontal pattern or facial appearance as slurry channels 58. The depth of slurry channels 58' decreases to approximately zero as the channel approaches wafer holding surface 52. This alternative embodiment may further reduce the accumulation of slurry by further limiting flow barriers at the wafer pad interface.

The rotational speed of conditioning pad 22 relative to semiconductor wafer 14 affects the amount of polishing that occurs in a CMP process. A greater rotational speed generates more heat from friction between semiconductor wafer 14 and conditioning pad 22. This problem primarily arises due to the nonuniform distribution of slurry 24 at the wafer-pad interface. Assuring a more uniform slurry layer with a greater rotational speed of semiconductor wafer 14 relative to conditioning pad 24 would make it possible to increase the semiconductor wafer 14 throughput. In fact, the present embodiment permits an exemplary carrier 16 to rotate at a relative speed of not less than 25 revolutions per minute and permits applying a force of not less than 5 pounds per square inch, while directing slurry 24 between semiconductor wafer 14 and conditioning pad 22 to maintain an essentially uniform slurry layer between semiconductor wafer 14 and conditioning pad 22.

Another important aspect of the present embodiment is that by maintaining a uniform level of slurry across semiconductor wafer 14, there is the more uniform temperature across semiconductor wafer 14 as it is polished by slurry 24 and conditioning pad 22.

A concern related to the over-polishing of semiconductor wafer 14 that FIGS. **2*a* and 2*b* show is the increase in the consumable rate that occurs by virtue of glazing of conditioning pad 22. If a sufficient layer of slurry 24 exists between semiconductor wafer 14 and conditioning pad 22, however, less glazing occurs. The reduction of glazing extends the useful life of conditioning pad 22 and may further reduce costs in the CMP processing of semiconductor wafer 14**.

OPERATION

Although operation of the method, apparatus, and system of the present embodiments is clear from the above description, the following explanation details operation of one embodiment that may be applied by modifying a device known as the Westech Avanti single wafer polishing system.

Carrier 16 with slurry channels 58 may also be used with a variety of other CMP systems. For example, the following table provides a list of possible CMP systems that may employ the present invention:

TABLE 1

| | CMP Planarization Equipment | | | | |
|---|---|---|---|---|---|
| | Cybeq Systems | Fujikoshi | SpeedFam Corp. | R. Howard Strasbaugh Inc. | Westech Systems Inc. |
| Model number/ Name | 3900 | 2PD-200 | CMP V Planarization System | 6DS-SP | 372 |
| Minimum/maximum wafer size | 100–300 mm | 150–200 mm | 150–200 mm | 75–200 mm | 125–200 mm |
| Type of wafer handling | Robotics | Vacuum chuck (automated) | Cassette-to-cassette | Robot feed cassette-to-cassette | Cassette-to-cassette |
| Polishing force range/accuracy (lbs) | 30–1000 | N.A. | 0–500 lbs ± 2 lbs | 0–500 lbs ± 2 lbs | 0–500 lbs ± 1 lb |
| Number of slurry systems | 2 | User defined | 2 | 2 | up to 4 |
| Slurry flow range in ml/min | 300–32,000 | 0–500 | 0–1000 | 0–1000 | 25–500 or 50–1000 |
| Conditioning speed | 1–30 rpm | Adjustable | Programmed | Programmed | Programmed |
| Conditioning cycles | Programmed | 5 step | Programmed | Programmed | Programmed |
| Number of wafers/cycle | 6 | 2 | 5 | 2 | 1 |
| Removable rate/ TEOS (Å/min) | 1000 | 100–1000 | 1000–3000 | 1000–3000 | up to 4000 |
| Weight | 6000 lbs | 5500 lbs | 13,000 lbs | 8500 lbs | 6800 lbs |

Variables in the process of the present embodiment include conditioning pad 22, the downward force with which carrier 16 applies semiconductor wafer 14 to conditioning pad 22, the back pressure from conditioning pad 22, the amount of pressure that robotic arm 20 applies to conditioning pad 22, and the amount of slurry 24 used to polish semiconductor wafer 14. In addition, the rotational speed of carrier 16 relative to conditioning pad 22 is an important process variable.

With these parameters in mind and using the Westech or one of the above-listed CMP systems, an operation may proceed by robotic arm 20 and carrier 16 moving to pick up semiconductor wafer 14. The vacuum force of carrier 16 holds semiconductor wafer 14 on wafer holding surface 52. Then, robotic arm 20 rotates carrier 16 in one direction while primary platen 18 rotates conditioning pad 22 in either the same or an opposite direction. Conditioning pad 22 receives slurry 24. As carrier 16 comes in contact with slurry 24 and conditioning pad 22, slurry inlet 60 receives slurry 24 and passes it through slurry channels 58. Slurry channels 58 then direct slurry 24 to the interface between wafer 14 and conditioning pad 22. This causes an improved, more uniform distribution of slurry 24 at the wafer-pad interface. As a result of this improved operation, the desired aspects of more uniform polishing and less heat generation from friction occur. The change of these process parameters permit increased rotational speeds and even greater downward force of semiconductor wafer 14, for greater CMP process throughput.

Although the invention has been described in detail herein with reference to the illustrative embodiments, it is to be understood that this description is by way of example only and is not to be construed in a limiting sense. It is to be further understood that numerous changes in the details of the embodiments of the invention and additional embodiments of the invention, will be apparent to, and may be made by, persons of ordinary skill in the art having reference to this description. It is contemplated that all such changes in additional embodiments are within the spirit and true scope of the invention as claimed below.

What is claimed is:

1. An improved wafer polishing carrier for holding a semiconductor wafer during a chemical mechanical polish process involving the use of a slurry between the semiconductor wafer and a conditioning pad, said carrier further for directing slurry between the semiconductor wafer and the conditioning pad and comprising:

a wafer holding surface for holding the semiconductor wafer as the semiconductor wafer contacts the conditioning pad and the slurry;

an outer rim portion surrounding said wafer holding surface; and a plurality of slurry channels associated with said outer rim portion for receiving the slurry and directing the slurry between the semiconductor wafer and the conditioning pad to maintain an essentially uniform layer of the slurry between the semiconductor wafer and the conditioning pad.

2. The carrier of claim 1, wherein said plurality of slurry channels comprises a plurality of curved slurry channels each having an inlet point and a curved slurry path for directing the slurry between the semiconductor wafer and the conditioning pad.

3. The carrier of claim 1, wherein each of said plurality of slurry channels comprises a width of approximately 0.10 inches.

4. The carrier of claim 1, wherein each of said plurality of slurry channels comprises a slurry ramp having a gradually tapering depth beginning at a greatest depth at the slurry inlet of the associated one of said plurality of slurry channels and tapering in depth to be an approximately in the same plane with said wafer holding surface.

5. An improved chemical mechanical polishing system for polishing a semiconductor wafer, comprising:

a conditioning pad having a conditioning surface for receiving the semiconductor wafer and polishing the surface;

a slurry for applying on said conditioning pad to lubricate the interface between the semiconductor wafer and said conditioning pad;

a carrier for holding the semiconductor wafer in contact with said conditioning pad and for maintaining an essentially uniform layer of said slurry between the semiconductor wafer and said conditioning pad, said carrier comprising:

a wafer holding surface for holding the semiconductor wafer as the semiconductor wafer contacts said conditioning pad and said slurry;

an outer rim portion surrounding said wafer holding surface; and a plurality of slurry channels associated with said outer rim portion for receiving said slurry and directing said slurry between the semiconductor wafer and said conditioning pad for maintaining an essentially uniform layer of said slurry between the semiconductor wafer and said conditioning pad.

6. The system of claim 5, wherein said plurality of slurry channels comprises a plurality of curved slurry channels each having an inlet point and a curved slurry path for directing the slurry between the semiconductor wafer and the conditioning pad.

7. The system of claim 5, wherein each of said plurality of slurry channels comprises a width of approximately 0.10 inches.

8. The system of claim 5, wherein each of said plurality of slurry channels comprises a slurry ramp having a gradually tapering depth beginning at a greatest depth associated with a slurry inlet point of one of said plurality of plurality of channels and tapering in depth to be approximately in the same plane and in contact with said wafer holding surface.

9. The system of claim 5, further comprising a spraying mechanism for spraying the semiconductor wafer with a solution including a pH controlling compound for controlling the preselected pH of said slurry and removing said slurry from the semiconductor wafer.

10. The system of claim 5, wherein said carrier rotates at a relative speed of not less than 25 revolutions per minute and further wherein said carrier directs said slurry to maintain an essentially uniform slurry layer between the semiconductor wafer and said conditioning pad.

11. The system of claim 5, wherein said carrier applies a force of not less than 5 pounds per square inch between the semiconductor wafer and said conditioning pad and further wherein said carrier directs said slurry to maintain an essentially uniform slurry layer between the semiconductor wafer and said conditioning pad.

12. A method for chemical mechanical polishing of a semiconductor wafer, comprising the steps of:

contacting the semiconductor wafer surface with a conditioning pad;

applying a slurry on the conditioning pad for lubricating the interface between the semiconductor wafer surface and the conditioning pad;

holding the semiconductor wafer with a carrier as the semiconductor wafer contacts the conditioning pad; and directing the slurry into the interface between the semiconductor wafer and the conditioning pad using a plurality of slurry channels associated with the carrier device for maintaining an essentially uniform slurry layer in the interface.

13. The method of claim 12, further comprising the step of directing the slurry between the semiconductor wafer and the conditioning pad using a plurality of curved slurry channels each having an inlet point and a curved slurry path.

14. The method of claim 12, further comprising the step of flowing the slurry through a plurality of slurry channels each having a width of approximately 0.10 inches.

15. The method of claim 12, further comprising the step of flowing the slurry through a plurality of slurry channels each comprising a slurry ramp having a gradually tapering depth beginning at a slurry inlet point associated with said slurry channel and tapering in depth to be approximately in the same plane and in contact with said wafer holding surface.

16. The method of claim 12, further comprising the step of spraying the semiconductor wafer with a solution including a pH controlling compound for controlling the preselected pH of the slurry for removing the slurry from the semiconductor wafer.

17. The method of claim 12, wherein said carrier rotates at a relative speed of not less than 25 revolutions per minute and further wherein the carrier directs the slurry to maintain an essentially uniform slurry layer between the semiconductor wafer and the conditioning pad.

18. The method of claim 12, further comprising the steps of applying a force of not less than 5 pounds per square inch while directing the slurry between the semiconductor wafer and said conditioning pad and further to maintain an essentially uniform slurry layer between the semiconductor wafer and the conditioning pad.

* * * * *